United States Patent [19]

Kleiner

[11] Patent Number: 5,029,618

[45] Date of Patent: Jul. 9, 1991

[54] ELECTROMAGNETIC CONTROL DEVICE FOR A DOBBY

[76] Inventor: Walter Kleiner, Schliereggstrasse 11, CH-8816 Hirzel, Switzerland

[21] Appl. No.: 499,364

[22] PCT Filed: Sep. 19, 1989

[86] PCT No.: PCT/CH89/00173

§ 371 Date: Jun. 5, 1990

§ 102(e) Date: Jun. 5, 1990

[87] PCT Pub. No.: WO90/04056

PCT Pub. Date: Apr. 19, 1990

[30] Foreign Application Priority Data

Oct. 7, 1988 [CH] Switzerland ..... 3732/88

[51] Int. Cl.[5] ..... D03C 1/00; H01F 7/14

[52] U.S. Cl. ..... 139/455; 335/234

[58] Field of Search ..... 335/234, 230, 229, 232, 335/78, 80, 81; 66/219, 221, 75.2; 139/455

[56] References Cited

U.S. PATENT DOCUMENTS 3,987,383 10/1976 Antonitsch ..... 335/78

4,437,078 3/1984 Bando et al. ..... 335/234 X

FOREIGN PATENT DOCUMENTS 2515703 5/1983 France .

*Primary Examiner*—Andrew M. Falik

*Attorney, Agent, or Firm*—Nies, Kurz, Bergert & Tamburro

[57] ABSTRACT

A control device for textile machines, in particular dobbies, has two magnet yokes with associated permanent magnets and an electromagnet, as well as an appropriately built magnet armature held in a first or second end position by the permanent magnet flux. When a current control pulse is applied to the electromagnet, however, the armature suddenly moves to the opposite end position, where it is again held until the next current control pulse moves it to the other end position. Only a very short current pulse is necessary to make the magnet armature change position. The resulting energy impulse is very intense and allows the holding and switching mechanical elements of dobbies to be directly controlled.

7 Claims, 2 Drawing Sheets

FIG. 1
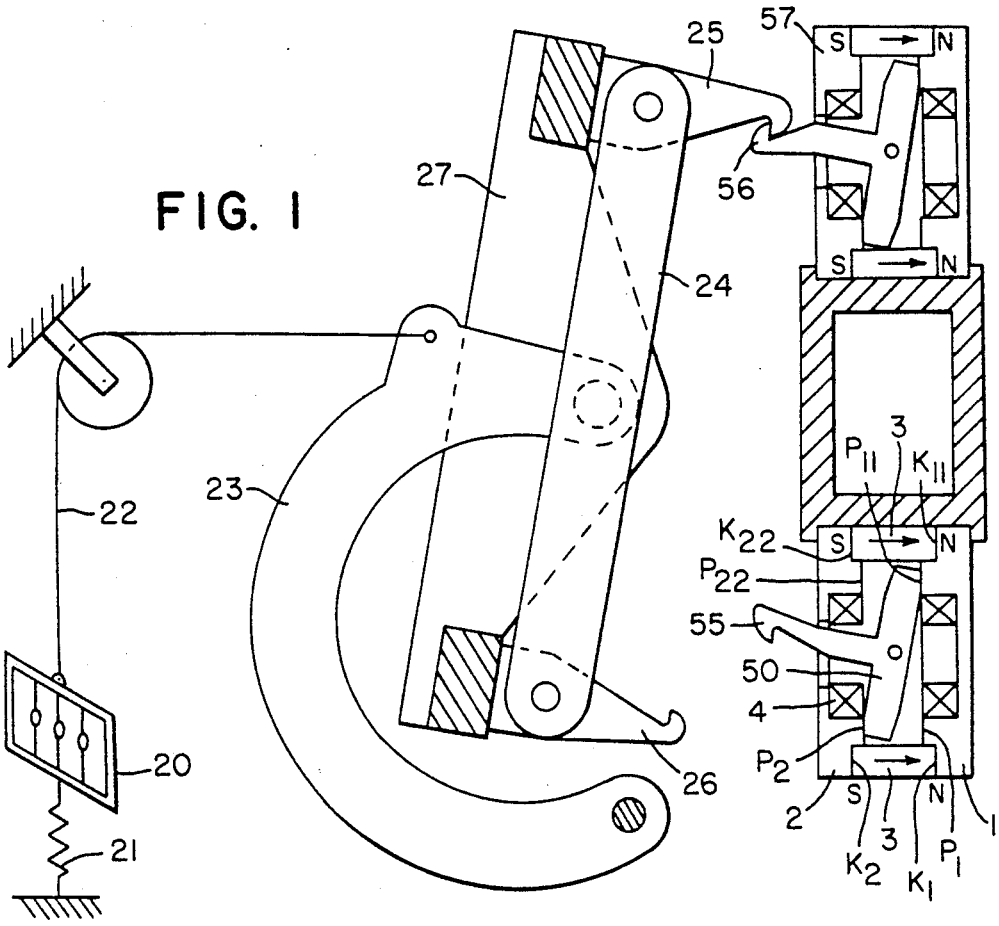
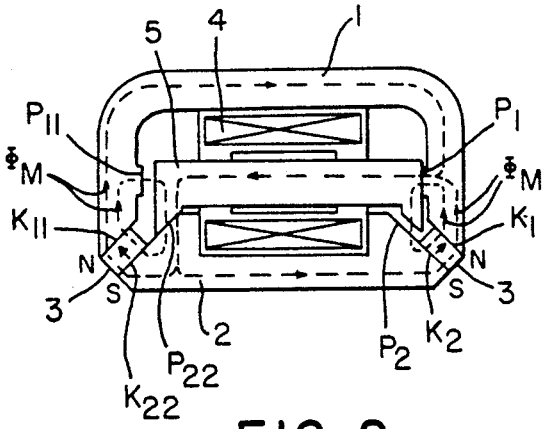
FIG. 2
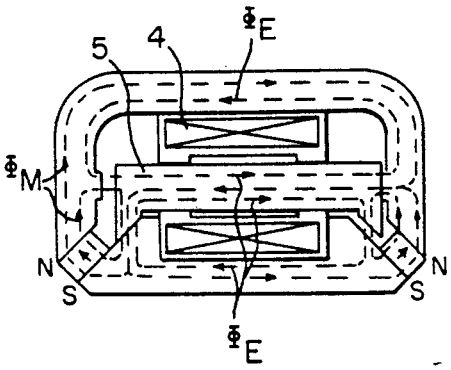
FIG. 3

ELECTROMAGNETIC CONTROL DEVICE FOR A DOBBY

BACKGROUND OF THE INVENTION

Field of the Invention

The invention relates to a control device for textile machinery, more particularly a control device for a dobby.

In the modern dobbies the weaving pattern in form of electrical signals is converted into mechanical control commands The interface between the electronics and the mechanics should contain as few elements as possible elements and have a high longevity at a high switching sequence.

Known control devices (see for instance French patent FR 81 21 106) use a cam driven mechanism which drives the electromagnet armature for the selection of the YES/NO of the control command onto the yoke of the magnet, whereby the electromagnet must provide the holding force for the magnet armature which is subjected to a spring force. Aside from the cam driven mechanics for the movement of the magnet armature and the electromagnet tension and/or pressure springs such control systems also include further mechanical elements such as pawls, and levers with corresponding glide surfaces which are necessary for mechanical force amplification. If the electromagnet is to attract the magnet armature for its control function without a mechanical aid, this magnet to provide corresponding power, will become large in structural and electrical dimensions as well, due to which the switching time grows longer due to the large mass of the armature, which detrimentally influences the performance of the dobby. The named mechanical parts are a subjected to wear, are cause of noise and vibrations, and lessen the disturbance free function of the dobby over a prolonged length of operation.

The invention is based on the object of reducing the plurality of the parts necessary for the controlling of a dobby, to increase the ease of maintenance, and to attain smooth running even at high revolutions.

SUMMARY OF THE INVENTION

This object is met in accordance with the invention in that a specific combination of high performance permanent magnets and electro-magnets is provides, along with a correspondingly selected magnet armature shape for reaching of the necessary working capacity for the controlling of mechanical switching operations with a minimum of mechanics. The advantages gained by the invention consist specifically in that a change of the position of the magnet armature is attained by very short electrical control impulses in a magnet coil, whereby a force impulse of a high intensity is generated during the change of the position of the magnet armature, and this force impulse is utilized for direct control of the dobby. The magnet armature is arrested at each end position without feeding electrical energy by utilizing the permanent magnet flux of the permanent magnets.

BRIEF DESCRIPTION OF THE DRAWINGS

Embodiments of the invention are illustrated in the drawings and will be described hereinbelow in closer detail.

There is illustrated in:

FIG. 1 is a schematic view showing a control device in accordance with the present invention, the device having a tilting armature suitable, for example, for controlling a dobby in a textile machine.

FIG. 2 is a schematic view showing another embodiment of a control device in accordance with the present invention, the control device having a linearly shiftable armature and showing a permanent magnet flux path provided by a pair of permanent magnets.

FIG. 3 is a schematic view similar to FIG. 2 showing an electromagnetic flux path superimposed on the permanent magnet flux path.

DESCRIPTION OF THE PREFERRED EMBODIMENTS

Figure 4:
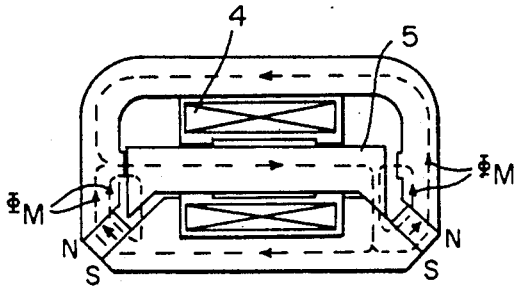
FIG. 4 is a schematic view similar to FIG. 2 showing the armature linearly shifted in position from the position shown in FIG. 1.

One possible application of the control device of the present invention in a dobby is illustrated in FIG. 1. In a conventional dobby in accordance with the invention, the heald frame 20 is pulled by a spring 21 into a end position, for instance a lower shed. The heald frame 20 is connected via pulling cable 22 to the pivotable lever 23, which supports a pivotable balance 24 at the opposite ends of which one respective pivotable hook 25, 26 is located. A rocket 27, which pivots in synchronism with the cycle of the weaving machine, moves the balance 24 with the hooks 25, 26 into the area of the retaining hooks 55, 56 of a control device 57. With the present invention, if the heald-frame 20 must in accordance with the pattern be brought from the power shed position into an upper shed position, the retaining hook 56 is moved by a control impulse provided by an electronic pattern control, by means of the control device 57, the structure and operation of which will be described hereinafter, to the hook 25 wherewith a form locked connection to the stationary control device 57 is produced. The rocker 27 then pivots into the other base position while the retaining hook 56 holds the hook 25, during which the hook 26 is pushed by the rocker 27 to the retaining hook 55. The lever 23 is subjected to a pivoting movement and pulls the heald-frame 20 by means of the pulling cable 22 into the upper shed position. If the heald-frame 20 must in accordance with the weave pattern again return into the lower shed position the retaining hook 55 is not shifted in position and the hook 26 is not engaged. If the heald-frame 20 must in accordance with the pattern remain in the upper shed position the retaining hook 55 is led towards the hook 26 to produce a form-locked connection to the stationary control device 57.

The basic operation procedure of the control device in accordance with the present invention is illustrated in FIGS. 2 to 4. In a bi-stable magnet system consisting of yoke shaped first and second pole pieces 1 and 2 of the coil 4, and a polarized permanent magnet 3, a movable armature 5 is designed such that it simultaneously abuts the pole face surfaces $P_1$ and $P_{22}$ such that the permanent magnet flux $\Phi_M$ retains the armature 5 in that position. As best seen in FIG. 2, first pole piece 1 includes first and second pole face surfaces $P_1$ and $P_{11}$, respectively, and it also includes first pole end surfaces $K_1$ and $K_{11}$, respectively. Similarly, second pole piece 2 includes third and fourth pole face surfaces $P_2$ and $P_{22}$, respectively, and it also includes pole end surfaces $K_2$ and $K_{22}$, respectively.

If in accordance with the control of the device a positional change of the armature 5 is demanded, a current directed impulse is fed into the coil 4 which generates an electromagnetic exciter flux $\Phi_E$ in the armature 5 which is directed oppositely to the permanent magnet flux $\Phi_M$ (FIG. 3). Accordingly, a flux difference $\Phi_m - \Phi_E$ results at the pole face surfaces $P_1$ and $P_{22}$ whereas the flux $\Phi_M$ remains at the pole face surfaces $P_{11}$ and $P_2$ (FIG. 3). This larger flux $\Phi_M$ in comparison with the flux $\Phi_M - \Phi_E$ brings the armature 5 from the stable contact position with $P_1$, $P_{22}$ into the stable contact position $P_{11}$, $P_2$ (FIG. 4). The armature 5 remains in contact with the pole faces $P_{11}$, $P_2$ due to the permanent magnet flux $\Phi_M$ without the need for current to flow through the coil 4.

If during a next following machine cycle, according to the control a change of the position of the armature 5 is again demanded, a current-directed impulse is led into the coil 4 which produces a electromagnetic flux $\Phi_E$ in the coil which is directed opposite to the permanent magnet flux $\Phi_M$ to return the control device to the condition illustrated in FIG. 2.

Figure 6:
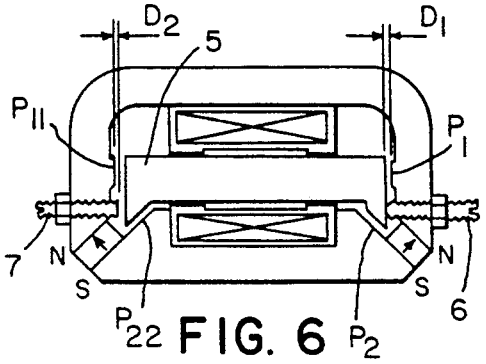
FIG. 6 is a schematic view similar to FIG. 2 showing adjustable armature abutments.

It is possible to influence the switching behavior of the control device by changing the armature end position to the pole face surfaces $P_1$, $P_{22}$ and $P_{11}$, $P_2$ by means of adjustable abutments 6, 7 such as illustrated in FIG. 6. A larger distance $D_1$ and $D_2$ between the armature 5 and the pole face surfaces $P_1$, $P_{22}$ and $P_2$, $P_{11}$ causes at the same current intensity in the coil 4 a shorter moving time of the armature 5 from one end position to the other end position.

Figure 7:
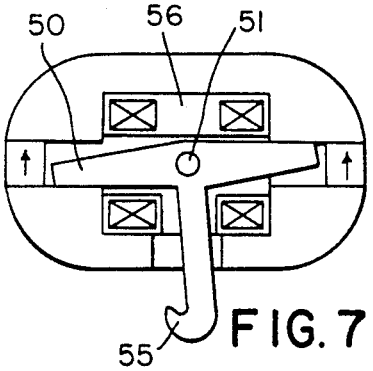
FIG. 7 is a schematic view of an embodiment similar to the embodiment shown in FIG. 1 and having a tilting armature.

It can be advantageous to design the armature regarding shape and function as a tilting armature 50. In the embodiment illustrated in FIG. 7 the tilting armature 50 is supported in the coil body 56 on pivot axis 51.

Figure 9:
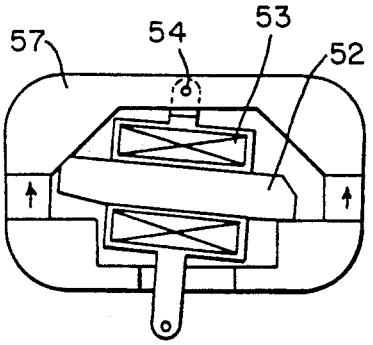
FIG. 9 is a schematic view of another embodiment of the present invention in which both the coil and the armature tilt together about a fixed axis.

A different position of the rotation bearing pivot axis for the tilting armature 52 is illustrated in FIG. 9, where the pivot axis 54 is located in yoke shaped magnet 59. In order to facilitate functional operations the tilting armature can extend outside of the control device 57, for instance as retaining hook 55, FIGS. 1 and 7.

For certain applications of the control device it may be of an advantage if the tilting armature 52 is held stationary in a coil body 53, and the coil body 53 pivots with the armature 52, as shown in FIG. 9.

Figure 8:
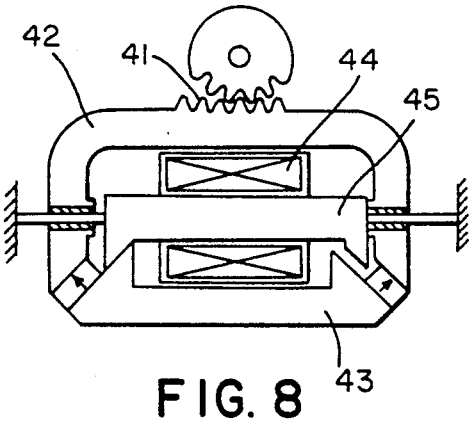
FIG. 8 is a schematic view of another embodiment of a control device, the device including a stationary armature and a movable yoke assembly.

FIG. 8 illustrates an embodiment where the armature 45 and the coil 44 are each stationary and the magnets, 42, 43 are movable the movement of which can be transmitted by other elements to the toothed segment 41.

Figure 5:
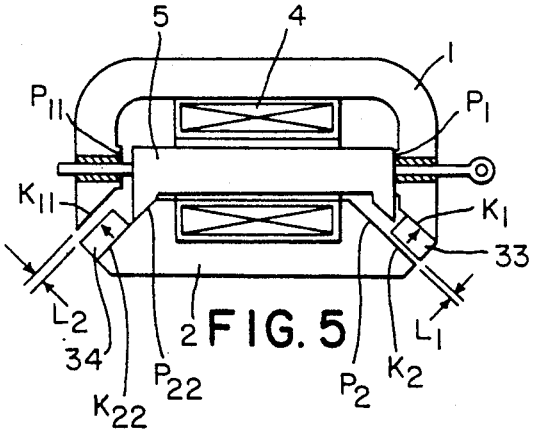
FIG. 5 is a schematic view similar to FIG. 2 showing another embodiment of a control device in accordance with the present invention, the device having permanent magnets that are asymmetrically positioned.

By arranging permanent magnets 33, 34 with one-sided air gap $L_1$ and $L_2$ relative to the pole and surfaces $K_{11}$ and $K_2$, a monostable switching behavior of the control device is arrived at, such as shown in FIG. 5. When no current is applied to coil 4, armature 5 is pulled onto the pole face surfaces $P_1$, $P_{22}$. If an electromagnetic excitation flux is generated in coil 4 which is directed opposite to the permanent magnet flux, the armature 5 moves towards the pole surfaces $P_{11}$, $P_2$ and remains in that position until the current is shut off from the coil, whereafter the armature 5 returns again into its initial position contacting the pole face surfaces $P_1$, $P_{22}$.

This automatic returning of the armature 5 without a spring force and retention thereof in the initial position by permanent magnet forces can lead to large advantages of the function and operation, and also to simple solutions regarding the electronic controls.

I claim:

1. A control device for controlling a movable element, such as a dobby in textile machinery, said control device comprising:

a. a first pole piece having a pair of spaced first and second pole face surfaces and a pair of spaced first pole end surfaces;

b. a second pole piece having a pair of spaced third and fourth pole face surfaces and a pair of spaced second pole end surfaces, each second pole end surface spaced from a respective first pole end surface to define a pair of gaps between the pole end surfaces of the first and second pole pieces;

c. a pair of permanent magnets, each permanent magnet positioned in a respective gap between the first and second pole pieces, the permanent magnets each having their respective poles oriented so that the same pole polarity of each permanent magnet is facing the same one of the first and second pole pieces to provide a permanent magnet flux in the pole pieces;

d. a coil positioned between the first and second pole pieces for providing an electromagnetic exciter flux within the pole pieces when current is applied to the coil;

e. an armature positioned within the coil and movable within the coil in response to the electromagnet exciter flux provided by the coil from a first armature position at which the armature is in contact with the first contact surface of the first pole piece and the third contact surface of the second pole piece, to a second armature position at which the armature is in contact with the second contact surface of the first pole piece and the fourth contact surface of the second pole piece, wherein the armature is retained at one of each of the first and second armature positions by the magnetic flux of the permanent magnets, and wherein energization of the coil provides an excitation magnetic flux that is sufficient in magnitude to shift the armature between the first armature position and the second armature position to permit the armature to be retained at one of the first and second armature positions by the magnetic flux of the permanent magnets upon deenergization of the coil and thereby provide a bistable control device.

2. Control device according to claim 1, in which the armature is linearly displaceably supported relative to the coil body.

3. Control device according to claim 1, including an armature pivot axis that passes through the coil and about which the armature is pivotable.

4. Control device according to claim 1, including adjustable abutment means for influencing the magnetic flux within the armature by providing a selectable spacing between the armature the first and second contact surfaces to change the movement time of the armature.

5. Control device according to claim 1, in which the armature is fixed in position relative to the coil and the coil and armature are together pivotable around an axis of rotation.

6. Control device according to claim 1, wherein the armature includes a retaining hook.

7. A control device according to claim 1, wherein one of the permanent magnets is in contact with one of the first pole face surfaces and is spaced from a corresponding one of the second pole face surfaces to define a first air gap, and adjacent the other first contact surface the other of the permanent magnets is in contact with the other of the second pole face surfaces and is spaced from the other of the first pole face surfaces to define a second air gap adjacent the second contact surface, wherein the first air gap is smaller than the second air gap to provide a greater magnetic attraction force to draw the armature to the first contact surface when the coil is not energized, to provide a monostable control device.

* * * * *